US005526087A

United States Patent [19]

Suzuki et al.

[11] Patent Number: 5,526,087

[45] Date of Patent: Jun. 11, 1996

[54] PHOTOSENSITIVE MATERIAL PROCESSING APPARATUS

[75] Inventors: Motoi Suzuki; Ryouei Nozawa; Mitsuru Katsumata, all of Kanagawa, Japan

[73] Assignee: Fuji Photo Film Co., Ltd., Kanagawa, Japan

[21] Appl. No.: 394,500

[22] Filed: Feb. 27, 1995

[30] Foreign Application Priority Data

Apr. 15, 1994 [JP] Japan ..... 6-076992

[51] Int. Cl.[6] ..... G03D 3/02

[52] U.S. Cl. ..... 354/324; 210/691

[58] Field of Search ..... 354/322–324, 354/317, 300; 355/27–29; 118/647, 659, 660; 134/64 P, 64 R, 122 P, 122 R; 428/35.3; 202/202, 181, 187; 159/11.1, 42, 43.1; 203/22, 20; 210/6 D, 692, 681, 691; 430/398–400

[56] References Cited

U.S. PATENT DOCUMENTS 3,995,298 11/1976 Vandeputte et al. ..... 354/324
4,769,661 9/1988 Aoki et al. ..... 354/324 X
4,791,013 12/1988 Koboshi et al. ..... 428/35.3
4,791,444 12/1988 Fujimoto et al. ..... 354/324
5,015,560 5/1991 Koboshi et al. ..... 430/398

FOREIGN PATENT DOCUMENTS 62-286046 12/1987 Japan .

*Primary Examiner*—D. Rutledge
*Attorney, Agent, or Firm*—Sughrue, Mion, Zinn, Macpeak & Seas

[57] ABSTRACT

A photosensitive material processing apparatus includes a drying device for drying with drying air a photosensitive material processed with processing solutions; a waste-solution recovering section, having an absorbing material, for recovering waste solutions of the processing solutions discharged from a plurality of processing tanks due to the absorbing material being impregnated with the waste solutions; and a waste-solution drying device having a duct for introducing warm air from the drying device into the waste-solution recovering section and adapted to dry a recovered waste solution. Since the waste solution is dried by the waste-solution drying device after recovery of the waste solutions of the processing solutions, intervals of maintenance provided for the waste-solution recovering section are extended, and the operating efficiency in waste solution processing is improved.

11 Claims, 4 Drawing Sheets

PHOTOSENSITIVE MATERIAL PROCESSING APPARATUS

BACKGROUND OF THE INVENTION

1. Field of the Invention

The present invention relates to a photosensitive material processing apparatus, and more particularly to a structure for processing a waste solution, which is used for a photosensitive material processing apparatus for processing a photosensitive material with processing solutions (e.g., a developing solution, a fixing solution, etc.).

2. Description of the Related Art

In photosensitive material processors such as automatic processors, a photosensitive material is processed with a developing solution, a fixing solution, and the like. Also, it is known that waste solutions are processed after they are discharged from processing solution tanks for processing the photosensitive material with the developing solution, the fixing solution, and the like in the photosensitive material processor.

As shown in FIG. 4, in a conventional method, waste solutions which are discharged from a developing tank 72, a fixing tank 74, and a washing tank 76 of an automatic processor 70 are accommodated in separate waste solution tanks 78, 80, and 82, and the waste solutions in the respective waste solution tanks 78, 80, and 82 are transferred to a predetermined disposal site before the waste solution tanks 78, 80, and 82 overflow. Also, it is known that the waste solutions are dried and converted into solids so as to facilitate disposal.

However, with the method using the waste solution tanks, since the waste solutions are stored in the waste solution tanks 78, 80, and 82, the waste solution tanks 78, 80, and 82 become full in a short time, and since the waste solutions in the waste solution tanks 78, 80, and 82 are transferred to a predetermined disposal site, the operating efficiency in waste solution processing has been poor. In addition, it has been inevitable for an apparatus for drying the waste solutions to become large in size mainly because a large-capacity heat source is used.

Further, since ammonium thiosulfate is used as a component of the conventional fixing solution, a large volume of waste solution is produced, so that intervals for processing the waste solutions have been short. The operating efficiency in waste solution processing has been poor in this respect as well.

SUMMARY OF THE INVENTION

In the light of the above-described problems, it is an object of the present invention to provide a photosensitive material processing apparatus which makes it possible to improve the operating efficiency in waste solution processing.

In accordance with a first aspect of the present invention, there is provided a photosensitive material processing apparatus comprising: a plurality of processing tanks for processing a photosensitive material with respective processing solutions; a drying device for drying with drying air the photosensitive material processed with the processing solutions; a waste-solution recovering section, having an absorbing material, for recovering waste solutions of the processing solutions discharged from the plurality of processing tanks due to the absorbing material being impregnated with the waste solutions; and a waste-solution drying device having a duct for introducing warm air from the drying device into the waste-solution recovering section and adapted to dry a recovered waste solution.

In accordance with a second aspect of the present invention, in the photosensitive material processor according to the first aspect of the invention, the plurality of processing tanks include at least a processing tank in which a developing solution is stored and a processing tank in which an ammonia-free fixing solution is stored, and the waste-solution recovering section has waste-solution introducing members for introducing waste solutions discharged from the plurality of processing tanks into an identical waste-solution recovering section.

In the photosensitive material processing apparatus in accordance with the first aspect of the present invention, after the waste solutions discharged from the processing tanks are recovered by the absorbing material of the waste-solution recovering section, the recovered waste solution is dried. For this reason, dehydrated or condensed processing agents remain in the absorbing material of the waste-solution recovering section, so that only a very small amount of waste solution needs to be processed as compared to a conventional case where the waste solution is processed as it is. Accordingly, intervals of maintenance provided for the waste-solution recovering section can be extended, and the operating efficiency in waste solution processing can be improved. More specifically, the operating efficiency in the waste solution processing can be further improved by replacing the absorbing material with another, as required.

As for the photosensitive material processing apparatus in accordance with the second aspect of the present invention, in the photosensitive material processing apparatus according to the first aspect of the invention, since the fixing agent and the developing agent are recovered into an identical waste-solution recovering section through the waste-solution introducing members, it becomes unnecessary to provide a plurality of waste-solution recovering sections, so that the structure becomes simple. At this time, since an ammonia-free fixing agent is used as the fixing agent, even if the fixing agent and the developing agent are mixed, no ammonia gas is produced. For this reason, it becomes unnecessary to provide the waste-solution recovering section for each processing solution, so that the structure becomes simple. In addition, since the ammonia-free fixing agent is used as the fixing agent, the amount of each processing solution used is reduced, so that the period of time until the waste-solution recovering section becomes fully filled with the waste solution is prolonged. Hence, intervals of maintenance provided for the waste-solution recovering section are extended, thereby making it possible to improve the operating efficiency in waste solution processing.

The above and other objects, features and advantages of the present invention will become more apparent from the following detailed description of the invention when read in conjunction with the accompanying drawings.

DESCRIPTION OF THE PREFERRED EMBODIMENT

Figure 1:
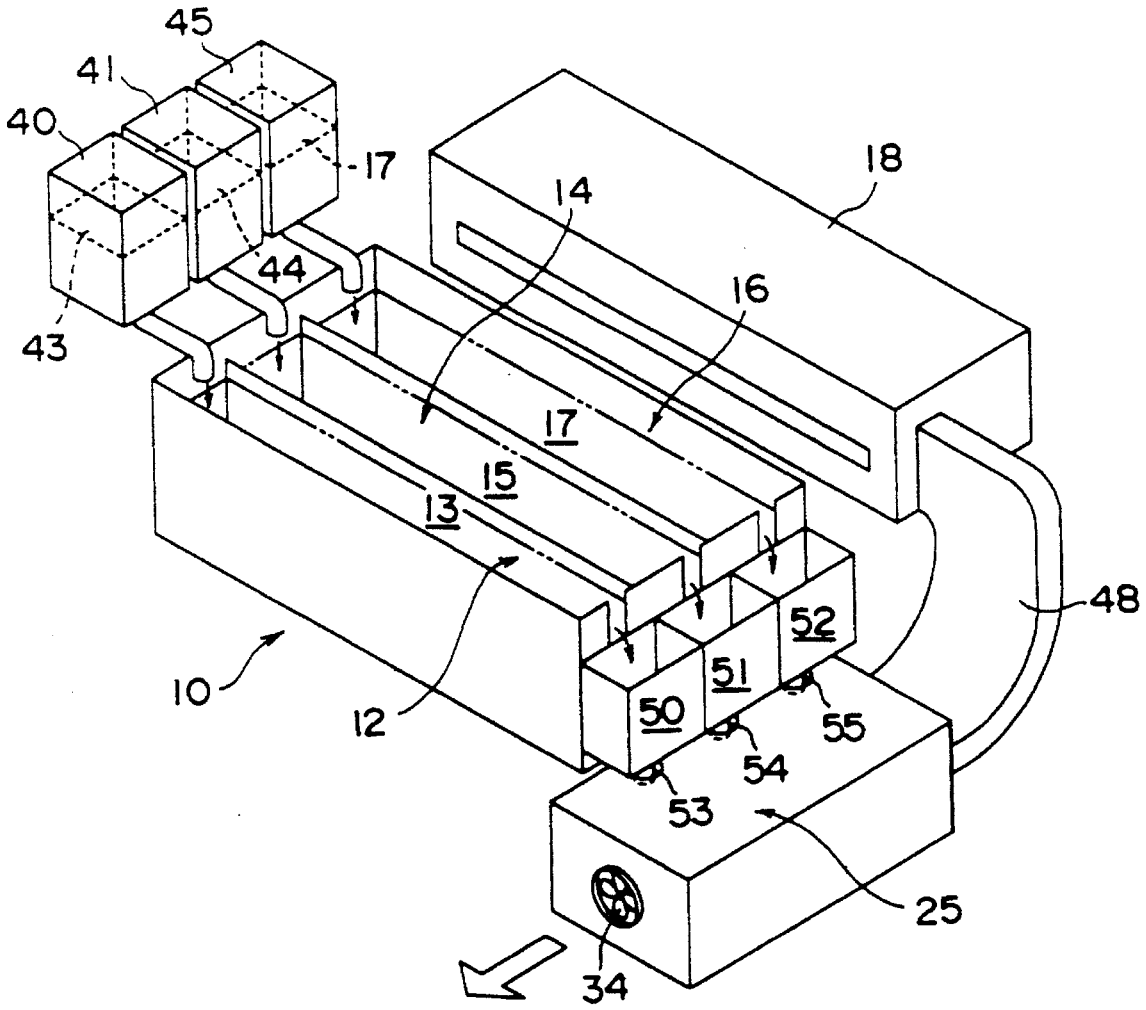
FIG. 1 is a schematic perspective view illustrating an automatic processor to which the structure for processing a waste solution in accordance with the present invention is applied.

FIG. 1 illustrates an automatic processor 10 to which the structure for processing a waste solution in accordance with an embodiment of the present invention is applied. This automatic processor 10 is provided with a developing tank 12, a fixing tank 14, a washing tank 16, and a drying section 18, and effects automatic processing by a known processing method by transporting a film (not shown) consecutively through the developing tank 12, the fixing tank 14, the washing tank 16, and the drying section 18.

A developing solution 13 is filled in the developing tank 12, and a replenishing solution 43 for development is supplied from a replenishing tank 40 to the developing tank 12 in proportion to the area of the film to be processed, which is detected by a film insertion sensor (not shown) provided in a film inserting port of the automatic processor 10. The developing solution 13 in an amount corresponding to the amount of replenishing solution 43 for development supplied from the replenishing tank 40 overflows from the developing tank 12 to an overflow tank 50. This overflowing solution flows through a pipe 53 and is stored in a vat 24 (see FIG. 2) serving as a waste-solution recovering section. Incidentally, when all the developing solution in the developing tank 12 is replaced, the developing solution 13 which is discharged may be stored in the vat 24.

A fixing solution 15 is filled in the fixing tank 14 in the same way as the developing solution 13 in the developing tank 12, and a replenishing solution 44 for fixing is supplied from a replenishing tank 41 to the fixing tank 14, as necessary. The fixing solution 15 which overflows from the fixing tank 14 flows to an overflow tank 51, and is recovered into the vat 24 through a pipe 54. Incidentally, an ammonia-free fixing agent, e.g., sodium thiosulfate, as a fixing component is used as the fixing solution 15, so that even if the fixing solution 15 is mixed with the developing solution 13, no ammonia gas is produced.

Washing water 17 is filled in the washing tank 16 in the same way as the fixing solution 15, and the washing water 17 is supplied from a replenishing tank 45 to the washing tank 16, as necessary. The washing water 17 which overflows from the washing tank 16 similarly flows to an overflow tank 52, and is supplied to the vat 24 through a pipe 55.

When the washing water 17 is supplied from the replenishing tank 45 to the washing tank 16, the overflowing washing water 17 is supplied to the vat 24, but in a case where running water is used as the washing water 17, the washing water 17 can be disposed of as general waste water since the degree of contamination is small although the amount of overflowing water is large.

Figure 2:
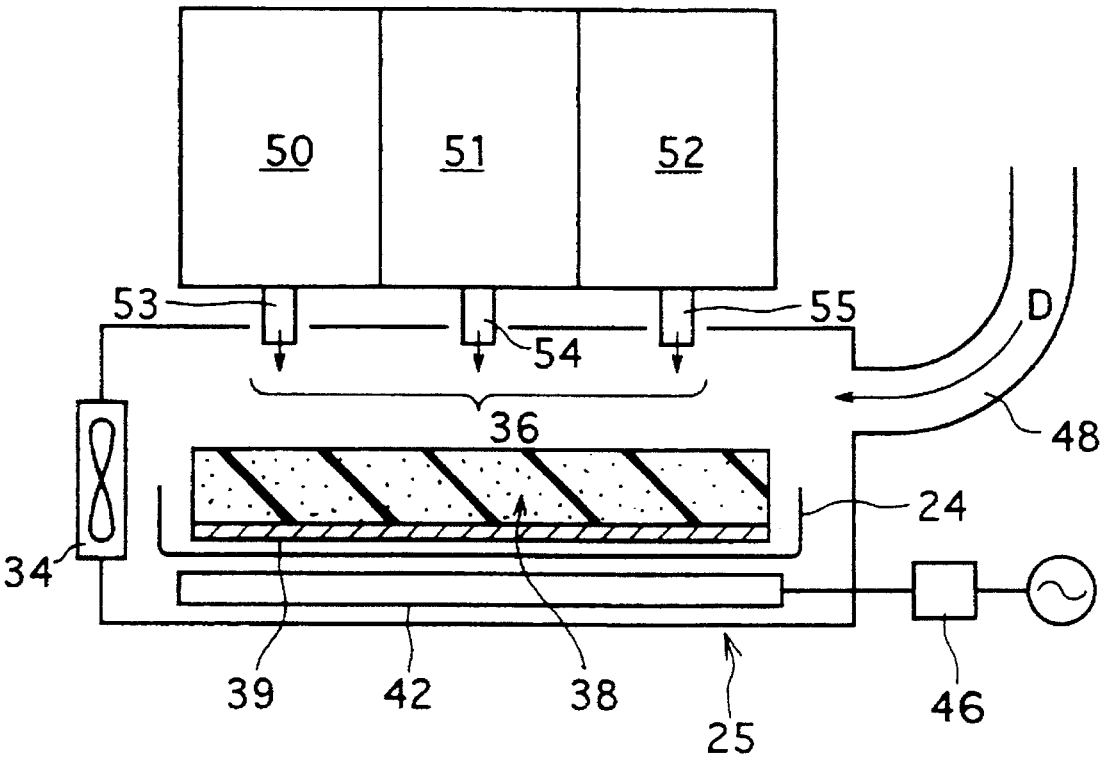
FIG. 2 is a schematic side cross-sectional view illustrating the structure for processing a waste solution in accordance with the present invention.

As shown in FIG. 2, the vat 24 is disposed in a box-shaped waste-solution recovering section 25 provided in the automatic processor 10. An exhaust fan 34 serving as a part of a waste-solution drying device is also disposed in the waste-solution recovering section 25 so as to dry the waste solution 36 in the vat 24 in a short time by exhausting the vapor which naturally evaporated above the vat 24 to outside the apparatus.

Hereafter, a description will be given of the operation of this embodiment.

In the structure for processing a waste solution in the embodiment, if the replenishing solution 43 for development is supplied, the developing solution 13 overflowing from the developing tank 12 flows to the overflow tank 50 and is discharged into the waste-solution recovering section 25 through the pipe 53. Similarly, if the replenishing solution 44 for fixing is supplied, the fixing solution 15 overflowing from the fixing tank 14 flows to the overflow tank 51 and is discharged into the waste-solution recovering tank 25 through the pipe 54. Further, if the washing water 17 is supplied, the washing water 17 in the washing tank 16 flows to the overflow tank 52 and is discharged into the waste-solution recovering tank 25 through the pipe 55. It should be noted that transport rollers and the like for transporting the film to the respective processing tanks are not shown in FIG. 1.

A fixing agent containing sodium thiosulfate as a fixing component is used as the fixing solution 15. Consequently, the amounts of waste solution, including the developing solution 13, the fixing solution 15, and the washing water 17, become considerably small as compared to a fixing agent which contains ammonium thiosulfate as a fixing component, and no ammonia gas is produced even if the developing solution 13 and the fixing solution 15 are mixed. Hence, it is unnecessary to provide the vat 24 for each processing solution, so that the structure can be simplified.

In addition, as the moist air in the box-shaped compartment in which the vat 24 is disposed is exhausted to outside the apparatus, the waste solution 36 in the vat 24 can be dried in a short time. For this reason, the dehydrated processing agents or a condensed waste solution remains in the vat 24, with the result that the time until the vat 24 becomes full is prolonged as compared with the conventional structure for processing a waste solution in which the waste solutions are stored as they are. In addition, the handling of the dehydrated processing agents or the waste solution is facilitated. Accordingly, intervals of maintenance provided for the vat 24 are extended, thereby making it possible to improve the operating efficiency in waste solution processing.

It should be noted that, instead of merely using the vat 24 in the waste-solution recovering section, an absorbing material 38 for being impregnated with the waste solution, such as a sponge, cloth, a foamed polyurethane sheet, or an absorbent containing a high-polymer absorbent, may be disposed on the vat 24, as shown in FIG. 2. In this case, since the dehydrated processing agents or the condensed waste solution is attached to or absorbed by the absorbing material 38, during maintenance for the waste-solution recovering section 25, it is sufficient to replace the absorbing material 38, thereby making it possible to further improve the operating efficiency in waste solution processing. In addition, a leakage preventing sheet 39 is preferably provided on the underside of the absorbing material 38 for preventing the waste solution from leaking from the lower portion of the absorbing material 38 and fouling the vat 24.

Additionally, a heater 42 serving as another part of the waste-solution drying device may be disposed below or in the vicinity of the vat 24 in the waste-solution recovering section 25. This heater 42 is capable of increasing the temperature of the waste solution to a predetermined level, as required, by a controller 46. The heater 42 is used in cases where dehydration by the drying air sent from the drying section 18, which will be described later, is insufficient.

Accordingly, in the structure for processing the waste solution provided with the heater 42, as the interior of the waste-solution recovering section 25 or the periphery of the vat 24 is heated by the heater 42, the water in the waste solution 36 contained in the vat 24 or absorbed by the absorbing material 38 can be made to evaporate in a short period of time. For this reason, the dehydrated processing agents or the condensed waste solution remains in the waste-solution recovering section 25, and the period of time until the vat 24 in the waste-solution recovering section 25 becomes full is prolonged as compared with the conventional structure for processing a waste solution in which the waste solution is stored as it is. Thus, the intervals of maintenance provided for the vat 24 are extended, and the handling of the dehydrated processing agents or the waste solution is facilitated. Accordingly, it is possible to improve the operating efficiency in waste solution processing. In particular, this advantage is noticeable if the waste solution is dried.

The waste-solution recovering section 25 in which the vat 24 and the absorbing material 38 are disposed forms a box-shaped chamber. The arrangement provided is such that the drying warm air used in the drying section 18 for drying the film in the automatic processor 10 is sent into the chamber in the direction indicated by arrow D through an air duct 48 serving as still another part of the waste-solution drying device.

Since the drying air is thus utilized, effective use is made of the drying warm air after drying the film, and it is possible to avoid the emission of heat which would aggravate the drying environment. The exhaust fan 34 is used to form an air flow inside the box-shaped chamber and exhaust the highly humid air to outside the apparatus.

As the drying air from the drying section 18 for drying a processed film is sent to an upper portion of the waste-solution recovering section 25 through the air duct 48, the waste solution 36 in the waste-solution recovering section 25 can be dried in a short time. For this reason, the dehydrated processing agents or the condensed waste solution remains in the waste-solution recovering section 25, so that the period of time until the vat 24 or the absorbing material 38 becomes full is prolonged as compared with the conventional structure for storing the waste solution as it is. Accordingly, the intervals of maintenance provided for the waste-solution recovering section 25 are extended, thereby making it possible to enhance the operating efficiency in waste solution processing.

Whether the waste solution is to be dehydrated only by the drying air through the air duct 48 or the heater 42 is to be used jointly can be determined on the basis of the environmental conditions, the amount of film processed by the automatic processor 10, and so on. Accordingly, the waste-solution drying device may not be provided with the heater 42, and may dehydrate the waste solution only by sending the drying air into the waste-solution recovering section 25 through the ar duct 48.

Figure 3:
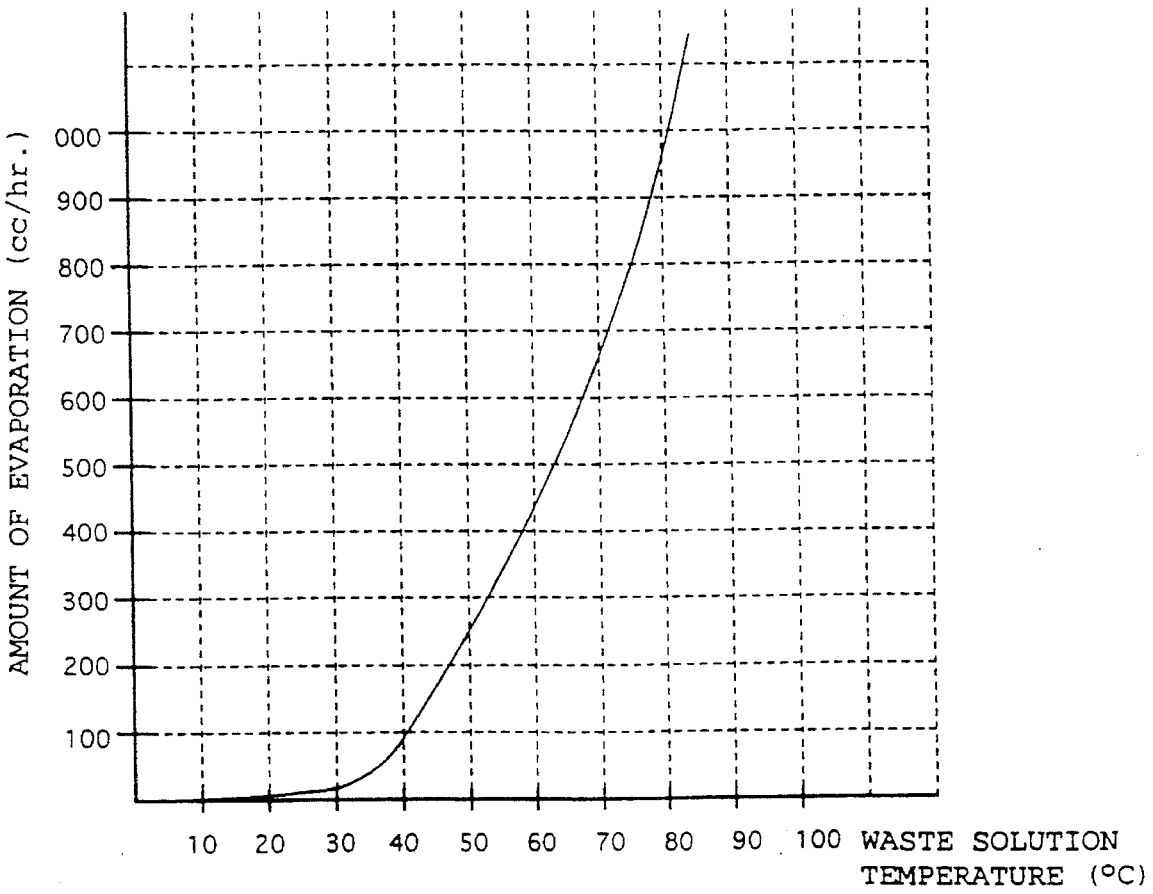
FIG. 3 is a graph illustrating the relationship between the temperature of the waste solution and the evaporation of water from an upper surface of an absorbing material.
Figure 4:
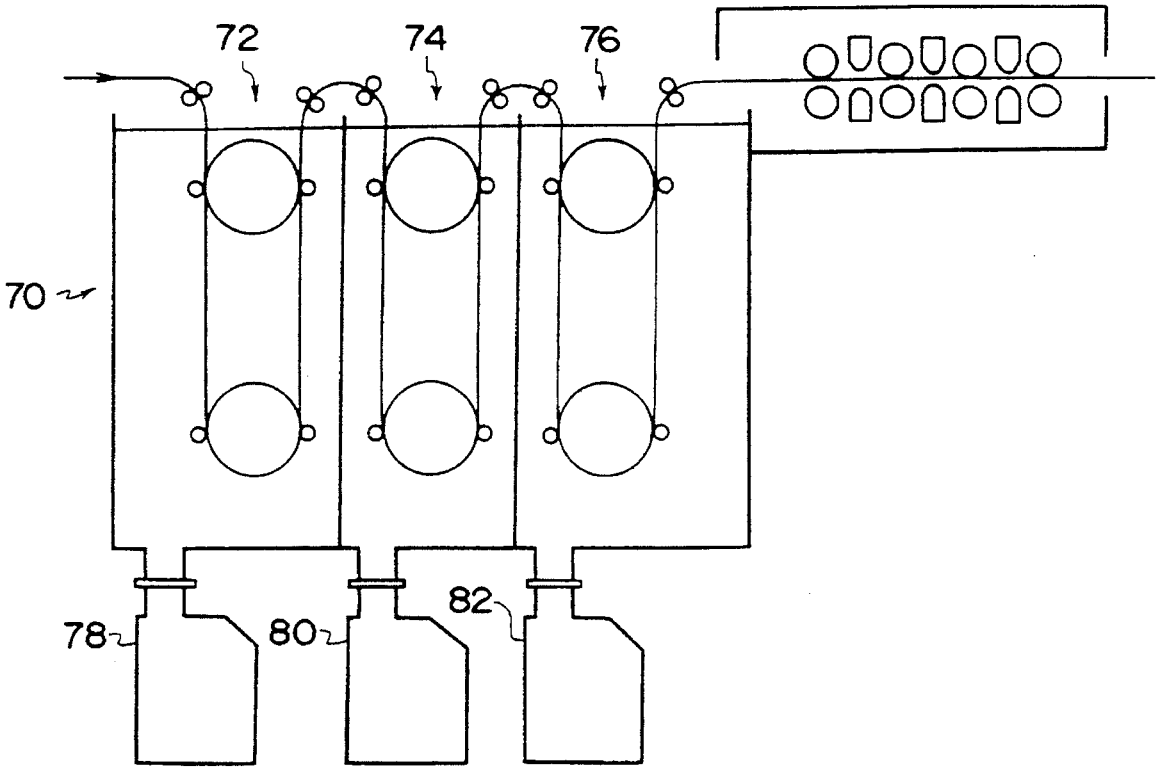
FIG. 4 PRIOR ART
FIG. 4 is a schematic side cross-sectional view illustrating an automatic processor to which a conventional structure for processing waste solutions is applied.

For example, in a case where the upper surface area of the absorbing material 38 is 30 cm×50 cm (1500 $cm^2$), an experiment revealed that the temperature of the waste solution absorbed by the absorbing material 38 and the evaporation of water from the upper surface of the absorbing material 38 has the relationship shown in FIG. 3.

If it is assumed that the amount of each replenishing solution replenished to the developing tank 12, the fixing tank 14, and the washing tank 16 is 25 cc per 10×12"-size film, the total amount of waste solution produced in processing one 10×12"-size film is 75 cc. If the operating hours of the automatic processor 10 for one day are 8 hours, and in order to dry the waste solution of the day within that day, the following can be said as drying requirements:

(1) In the case of the automatic processor for processing ten 10×12"-size films in one day, since the amount of waste solution is 750 cc, it is necessary to evaporate water of 93.8 cc per hour. For that purpose, it is necessary to heat the temperature of the waste solution to 40° C. or above according to FIG. 3. For this reason, it suffices if the drying-air temperature introduced to the waste-solution recovering section 25 is set to 60° C. or thereabouts. Since the temperature of drying air is generally used in a range of 40° C. to 60° C., the waste solution can be heated to 20° C. to 40° C.

(2) In the case of the automatic processor for processing one hundred 10×12"-size films in one day, since an evaporation amount of 937.5 cc is required per hour, it is necessary to heat the temperature of the waste solution to 80° C. or above according to FIG. 3. For this reason, it is necessary to use the heater 42 in the waste-solution recovering section 25.

Thus the means for evaporation may be selected in accordance with the amount of film processed by the automatic processor 10. Incidentally, if the amount of processing is extremely small, the waste solution may even evaporate at the atmospheric temperature. However, during a winter season or when the room temperature is 10° C. or below, the amount of evaporation is determined by the saturated vapor pressure in the waste-solution recovering section, so that heating is often required.

As described above, the structure for processing a waste solution in accordance with the first aspect of the present invention offers an outstanding advantage in that the intervals of maintenance provided for the waste-solution recovering section are extended, thereby improving the operating efficiency in waste solution processing.

In addition, the structure for processing a waste solution in accordance with the second aspect of the present invention offers outstanding advantages in that it becomes unnecessary to provide a waste-solution recovering section for each processing solution, and the structure is simplified, and that, since the amount of each processing solution used is reduced, the intervals of maintenance provided for the waste-solution recovering section are extended, and the handling of the waste solution is facilitated, thereby improving the operating efficiency in waste solution processing.

What is claimed is:

1. A photosensitive material processing apparatus comprising:

a plurality of processing tanks for processing a photosensitive material with respective processing solutions;

a drying device for drying with drying air the photosensitive material processed with the processing solutions;

a common waste-solution recovering section, having an absorbing material, for recovering waste solutions of all of the processing solutions discharged from said plurality of processing tanks due to said absorbing material being impregnated with the waste solutions; and a waste-solution drying device having a duct for introducing warm air from said drying device into said waste-solution recovering section and adapted to dry a recovered waste solution.

2. A photosensitive material processing apparatus according to claim 1, wherein said plurality of processing tanks include at least a processing tank in which a developing solution is stored and a processing tank in which an ammonia-free fixing solution is stored, and said common waste-solution recovering section has waste-solution introducing members for introducing waste solutions discharged from said plurality of processing tanks into said common waste-solution recovering section.

3. A photosensitive material processing apparatus according to claim 2, wherein said common waste-solution recovering section has a waste-solution storing member for storing the waste solution.

4. A photosensitive material processing apparatus according to claim 3, wherein said absorbing material is disposed in said waste-solution storing member.

5. A photosensitive material processing apparatus according to claim 2, wherein said waste-solution drying device has an air-exhausting member for exhausting air, which contains water evaporated from the waste solution, to outside.

6. A photosensitive material processing apparatus according to claim 3, wherein said waste-solution drying device has a heating member located in a vicinity of said waste-solution storing member, said heating member being adapted to evaporate the water of the waste solution stored in said waste-solution storing member.

7. A photosensitive material processing apparatus comprising:

a developing tank for developing a photosensitive material with a developing solution;

a fixing tank for processing the developed photosensitive material with an ammonia-free fixing solution;

a drying device for drying with warm air the photosensitive material processed in a plurality of processing tanks including said developing tank and said fixing tank;

a common waste-solution recovering section having a vat in which a waste solution of at least the developing and fixing solutions discharged from said plurality of processing tanks is stored, and having an absorbing material disposed in said vat, said absorbing material being impregnated with all of the stored waste solution;

a warm-air introducing member for introducing warm air from said drying device into said waste-solution recovering section; and a waste-solution drying device having an exhaust fan for exhausting water evaporated from the waste solution to outside, so as to dry the waste solution.

8. A photosensitive material processing apparatus according to claim 7, wherein said common waste-solution recovering section has waste-solution introducing members for introducing waste solutions discharged from said plurality of processing tanks into said common waste-solution recovering section.

9. A photosensitive material processing apparatus according to claim 8, wherein said waste-solution introducing members are pipes which are provided in correspondence with said plurality of processing tanks, respectively.

10. A photosensitive material processing apparatus according to claim 7, wherein said absorbing material has a leakage preventing sheet disposed on a bottom surface of said absorbing material, so as to prevent the waste solution absorbed by said absorbing material from leaking to said vat.

11. A photosensitive material processing apparatus according to claim 7, wherein said waste-solution drying device has a heating member located in a vicinity of said vat, said heating member being adapted to evaporate the water of the waste solution stored in said vat.

* * * * *